US006729145B1

(12) United States Patent
Overået al.

(10) Patent No.: US 6,729,145 B1
(45) Date of Patent: May 4, 2004

(54) PROCESS PLANT

(75) Inventors: Sverre Johannesen Overå, Oslo (NO); Per Salater, Oslo (NO)

(73) Assignee: Norsk Hydro ASA, Olso (NO)

( * ) Notice: Subject to any disclaimer, the term of this patent is extended or adjusted under 35 U.S.C. 154(b) by 0 days.

(21) Appl. No.: 09/673,467

(22) PCT Filed: Apr. 16, 1999

(86) PCT No.: PCT/NO99/00123

§ 371 (c)(1),
(2), (4) Date: May 2, 2001

(87) PCT Pub. No.: WO99/54658

PCT Pub. Date: Oct. 28, 1999

(30) Foreign Application Priority Data

Apr. 17, 1998 (NO) ..... 19981734

(51) Int. Cl.[7] ..... F25V 1/00; F17C 13/12

(52) U.S. Cl. ..... 62/50.7; 62/50.4; 62/606; 137/455; 196/133; 208/179

(58) Field of Search ..... 62/54, 50, 55, 62/50.4, 50.7, 606; 55/88, 89; 203/100; 202/163; 196/133; 137/455; 208/179

(56) References Cited

U.S. PATENT DOCUMENTS 1,918,100 A * 7/1933 Harnsberger ..... 220/749
3,714,790 A * 2/1973 Battey ..... 62/48.2
3,733,838 A * 5/1973 Delahunty ..... 62/48.2
3,844,262 A * 10/1974 Dieges ..... 123/567
3,877,240 A * 4/1975 Kniel et al. ..... 62/240
3,903,708 A * 9/1975 Mair ..... 62/48.2
4,637,440 A * 1/1987 Potter ..... 137/203
5,030,339 A * 7/1991 Czarnecki ..... 208/351
6,045,659 A * 4/2000 Bjoerkhaug et al. ..... 196/132

FOREIGN PATENT DOCUMENTS

WO 94-25541 11/1994

* cited by examiner

*Primary Examiner*—Virginia Manoharan
(74) *Attorney, Agent, or Firm*—Wenderoth, Lind & Ponack, L.L.P.

(57) ABSTRACT

A process plant (1) for handling combustibles fluids, for example an oil production plant in which gaseous hydrocarbons are separated from oil and in which surplus gases or residual gases from uncontrolled build-ups of gas pressure in the process escape through process or safety valves in the plant and are conducted to a collection line (9). The surplus or residual gases are conducted via the collection line (9) to one or more low-pressure stores (2) and a connection line or return line (11, 3) is arranged from the store(s) (2) to the process or another treatment unit for processing the returned or collected fluid. The low-pressure store(s) can expediently comprise the crude oil or raw product store (2) of the process plant upstream of the process plant.

7 Claims, 2 Drawing Sheets

PROCESS PLANT

Figure 1:
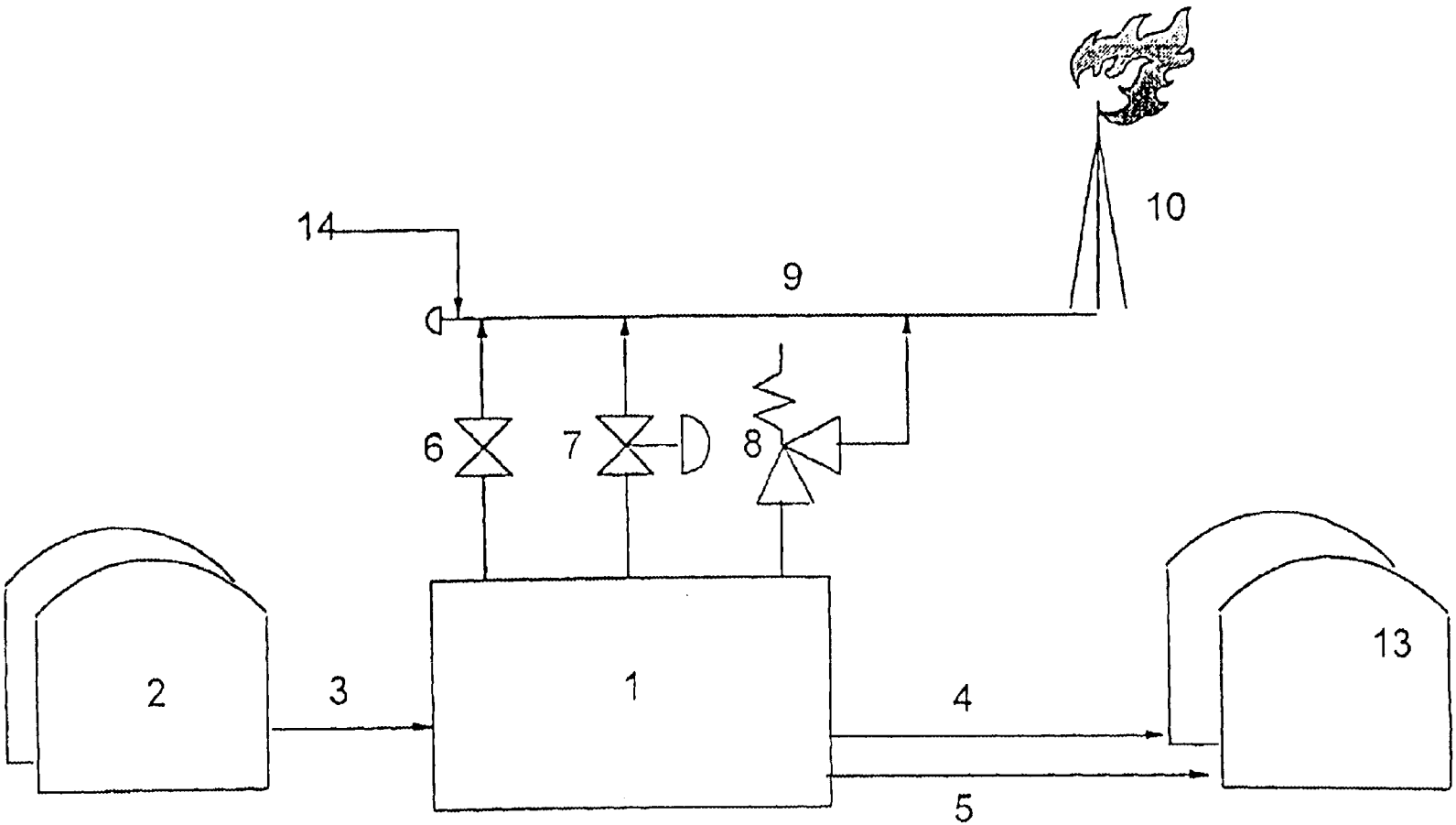

The present invention relates to a process plant for handling combustible fluids, for example an oil production plant in which gaseous hydrocarbons are separated from oil and in which surplus gases or residual gases from uncontrolled build-ups of gas pressure in the process escape through process or safety valves in the process plant and are conducted to a collection line.

It should be stressed that the expression process plant means not only plants for oil production in which hydrocarbon gases are separated from oil, but also refining plants and all types of equipment or plant in which combustible fluids are formed which must be handled optimally in terms of safety, finance and the environment.

In a process plant, for example a plant for the production of oil, there will normally be a large number of separators, compressors and/or other process equipment which are connected, in the process pipe line system, with valves, pressure regulators, temperature regulators and other components which, in given situations, may fail and lead to leaks, uncontrolled build-up of pressure, etc. The plant therefore has integral safety systems in the form of pressure control valves, safety valves and blow down valves which are connected to and will conduct surplus or residual fluids to a collection line for further transport to a flare for burning or emission into the atmosphere. In connection with flare burning, a combustion gas is usually added to the collection line continuously to ensure that a minimum flame is maintained in the flare. In connection with emission into the atmosphere without burning, an inert gas is usually added to prevent explosion.

British patent application no. 2.066.936 describes a refining plant for oil in which surplus gases in the form of hydrocarbons are recovered. The surplus gases are diverted from a flare line system and condensed in one or more stages by compression and cooling. The condensate is returned to the process. The residual gas, however, is conducted to a flare tower and burned.

East German patent specification no. 266.006 mentions a plant for combining combustible gases from several sources with different compositions in two main streams. The gases are combined using a computer which regulates the mixture on the basis of measurements of the calorific value of the gases. The gases are burned in a flare tower.

Moreover, Norwegian patent no. 177161 describes a solution for recovering surplus gas from an oil/gas treatment plant in which the surplus gas is collected in a collection line and recovered while gas which escapes in an emergency situation in connection with an abnormal increase in pressure (blow out) is conducted to a branch line for burning in a flare tower.

For all of the above known solutions, flares are used to burn all or part of the surplus gases or residual gases from the process plant. However, the use of a flare entails several disadvantages:

- The construction of the flare (flare tower) in itself is very expensive and will account for a not inconsiderable part of the overall costs of a process plant.
- Burning or emitting the surplus gases represents an environmental problem as CO, and hydrocarbon gases will, among other things, contribute to the greenhouse effect.
- The surplus gases or fluids are valuable in themselves and represent a direct financial loss when burned or emitted into the environment.

The present invention describes a device in connection with a process plant in which the stated disadvantages have been eliminated, i.e. in which the flare has been removed and all surplus gases and residual gases are dealt with and recycled.

The present invention is characterised in that the surplus or residual gases are conducted via a collection line to one or more low-pressure stores and that a connection line or return line is arranged from the store's gas area to the process or another treatment unit for the processing of the gas.

Claims 2–3 define advantageous features of the invention.

The present invention will be described in the following in further detail by means of examples and with reference to the attached drawings, where FIG. 1 shows a simplified process diagram for a traditional process plant with a flare tower.

Figure 2:
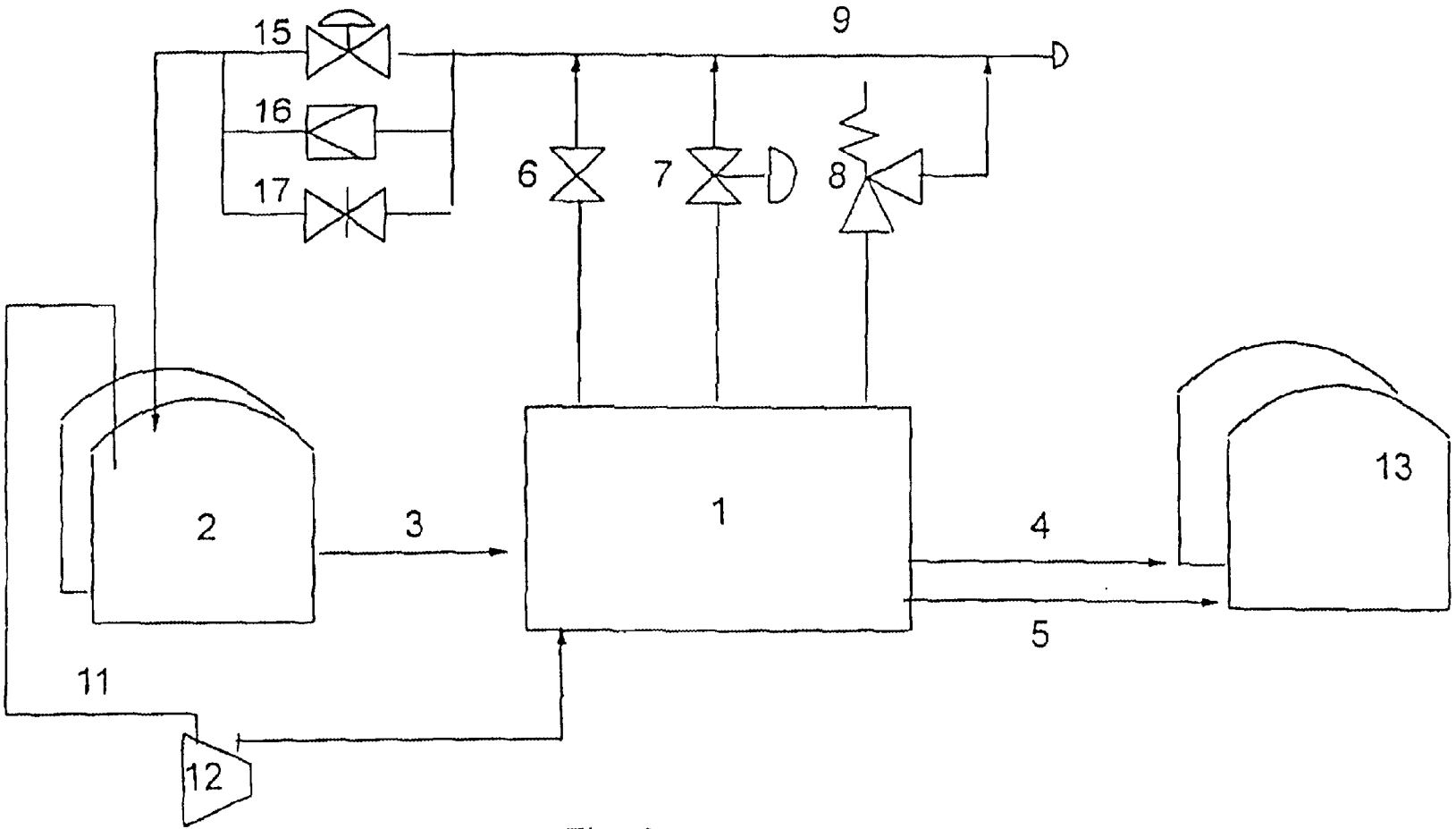

FIG. 2 shows a simplified process diagram for a process plant in accordance with the present invention without a flare tower.

FIG. 1 shows, as stated, a simplified process diagram of a traditional process plant, for example an oil production plant, in which a flare tower is used to burn the surplus gases. The raw product or crude oil is added to the process 1 from one or more low-pressure crude oil stores 2 via a line 3. The process itself may comprise several process stages with compressors and condensers (not shown) and is designed to separate gaseous hydrocarbons from the oil and transfer them as processed products, for example via lines 4, 5, to an appropriate product store 13.

A process plant like this will, as stated in the introduction, contain equipment and components, for example valves, pressure regulators and temperature regulators, which may fail and lead to leaks and build-ups of pressure. The plant will, therefore, be fitted with blow down valves (BDV), pressure control valves (PV) and pressure safety valves (PSV) 6, 7, 8, which are designed to allow fluid (gas) to escape in connection with a shutdown and when unforeseen leaks or build-ups of pressure occur. These fluids are collected in a collection line 9 and conducted to a flare tower 10 for burning or emission into the atmosphere. In the latter case, inert gas is also added from an inert gas source (not shown) via line 14.

FIG. 2 shows a simplified process diagram of the solution in accordance with the present invention. The process is the same as in the example shown in FIG. 1 and described above but the flare tower has been eliminated by the fluid which is collected in the collection line 9 being returned to the low-pressure crude oil store 2 upstream of the process plant.

Surplus gases which are collected in the store 2 can expediently be returned to the process as gas for reuse via line 11. If the conditions are present, some of the gas will condense in the low-pressure store 2. This condensed gas and any liquid from the fluid can expediently be returned to the process via the raw product line 3. In order to create lower pressure and thus increased capacity in the store 2, a fan or compressor 12 can also be arranged in connection with the return line 11. It should be noted that the present invention will require a relatively large store volume to be able to work within fixed safety margins. Such a volume will usually exist at all major crude oil plants.

However, it should also be noted that the present invention as it is described in the claims is not restricted to a solution in which the surplus gases or fluids have to be conducted to the low-pressure product store. It is possible to establish a separate store volume, for example a separate tank to which the surplus gases are conducted. Moreover, the collected gas or fluid (liquid) does not have to be returned to the process but can be conducted to another separate treatment unit (not shown). Moreover, a control valve 15 should be arranged in connection with the collection line 9 in order to isolate the low-pressure store 2 from the process when the plant is not in operation. Moreover, surplus pressure protection 17 should be arranged in parallel with the control valve 15 in case the latter fails to open. A manual stop valve (diverter valve) 17 should be used to allow maintenance of the control valve 15 and the surplus pressure protection 17.

The present invention describes a solution in connection with a process plant which has a number of advantages compared with the known solutions:

The use of a flare tower with associated equipment is completely eliminated and the investment costs in connection with the construction of the process plant and the maintenance costs are therefore considerably less.

By eliminating the use of a flare, emissions of environmentally hazardous hydrocarbon gases, CO2 and NOx gases are avoided. At the same time, major savings are achieved as there will be no need to add gas to the pilot flare and as the surplus gases are returned to the process and "reused".

As the construction of a flare tower is not necessary, the visually unattractive structure of the flare tower is also avoided. Moreover, the unattractive flare, the high noise level and the smoke which are associated with the use of a flare are also avoided.

Moreover, the present invention offers an improvement in safety, among other things because the use of an open flame is eliminated and the relief of surplus pressure built up will be shorter?.

What is claimed is:

1. A processing plant for handling combustible fluids, comprising:

a processing section operable to process combustible fluids;

a gas value connected with said processing section operable to relieve gas pressure from said processing section by conducting surplus or residual gas from said processing section;

a collection line connected with said gas valve, said gas valve being operable to conduct the gas from said processing section to said collection line;

at least one low-pressure store, said collection line being connected to said at least one low-pressure store such that the gas from said processing section is conducted to said at least one low-pressure store; and at least one second line connected to said at least one low-pressure store operable to conduct fluid from said at least one low-pressure store;

wherein:

said processing section is operable to separate gaseous hydrocarbons from oil; and said at least one low-pressure store comprises a crude oil store upstream of said processing section.

2. A processing plant for handling combustible fluids, comprising:

a processing section operable to process combustible fluids;

a gas valve connected with said processing section operable to relieve gas pressure from said processing section by conducting surplus or residual gas from said processing section;

a collection line connected with said gas valve, said gas valve being operable to conduct the gas from said processing section to said collection line;

at least one low-pressure store, said collection line being connected to said at least one low-pressure store such that the gas from said processing section is conducted to said at least one low-pressure store; and at least one second line connected to said at least one low-pressure store operable to conduct fluid from said at least one low-pressure store;

wherein said at least one low-pressure store comprises a raw product store upstream of said processing section, said raw product store includes a gas area, and said at least one second line comprises a return line connected between said gas area and said processing section and a raw product line between said at least one low-pressure store and said processing section, such that any condensed gas and liquid from fluid added to said at least one low-pressure store through said collection line can be returned to said processing section.

3. The processing plant of claim 2, wherein a fan or compressor is provided in said return line.

4. A processing plant for handling combustible fluids, comprising:

a processing section operable to process combustible fluids;

a gas valve connected with said processing section operable to relieve gas pressure from said processing section by conducting surplus or residual gas from said processing section;

a collection line connected with said gas valve, said gas valve being operable to conduct the gas from said processing section to said collection line;

at least one low-pressure store, said collection line being connected to said at least one low-pressure store such that the gas from said processing section is conducted to said at least one low-pressure store; and at least one second line connected to said at least one low-pressure store operable to conduct fluid from said at least one low-pressure store;

wherein said collection line is not connected with a flare tower.

5. A processing method for handling combustible fluids, comprising:

processing combustible fluids in a processing section;

relieving gas valve from said processing section by conducting surplus or residual gas from said processing section using a gas value connected with said processing section;

conducting the gas from said processing section to a collection line connected with said gas valve;

conducting the gas from said processing section to a least one low-pressure store with the collection line, the collection line also being connected to said at least one low-pressure store; and conducting fluid from said at least one low-pressure store with at least one second line connected to said at least one low-pressure store;

wherein said at least one low-pressure store comprises a raw product store upstream of said processing section, said raw product store includes a gas area, and said at least one second line comprises a return line connected between said gas area and said processing section and a raw product line between said at least one low-pressure store and said processing section, and further comprising returning any condensed gas and liquid from fluid added to said at least one low-pressure store through said collection line to said processing section.

6. The processing method of claim 5, wherein a fan or compressor is provided in said return line.

7. The processing method of claim 5, wherein said collection line is not connected with a flare tower.

* * * * *